United States Patent [19]

Brown et al.

[11] Patent Number: 4,766,841

[45] Date of Patent: Aug. 30, 1988

[54] FLEXOGRAPHIC PRESS APPLIED PAPER COLOR COATING

[76] Inventors: Richard C. Brown, Somers, Conn.; Robert E. Lafler, Charlton City; Joseph M. Murphy, Wilbraham, both of Mass.; Westvaco Corporation, 02, New York, N.Y.

[21] Appl. No.: 48,218

[22] Filed: May 11, 1987

Related U.S. Application Data

[62] Division of Ser. No. 766,647, Aug. 19, 1985, abandoned.

[51] Int. Cl.[4] ..... B05C 1/08

[52] U.S. Cl. ..... 118/75; 118/249; 118/262; 118/DIG. 15

[58] Field of Search ..... 118/249, 262, 75, DIG. 15; 101/350

[56] References Cited

U.S. PATENT DOCUMENTS 3,613,578 10/1971 Heurich ..... 101/350

3,818,830 6/1974 Schultz ..... 101/350

*Primary Examiner*—John P. McIntosh

*Attorney, Agent, or Firm*—W. A. Marcontell; R. L. Schmalz

[57] ABSTRACT

This process is directed to the coloration of envelope and stationery grades of white paper stocks with a water based ink coating. Characteristics of the flexographic process include both press and ink specifications. Critical mechanical or material characteristics are associated with each of the fountain roll, the anilox roll, the plate roll and the impression roll of a flexographic printing system. Used in conjunction with the critical combination of press characteristics is a unique, water-based ink formulation for rapidly coloring an entire web side with a colored ink to simulate the appearance of a colored paper stock.

4 Claims, 1 Drawing Sheet

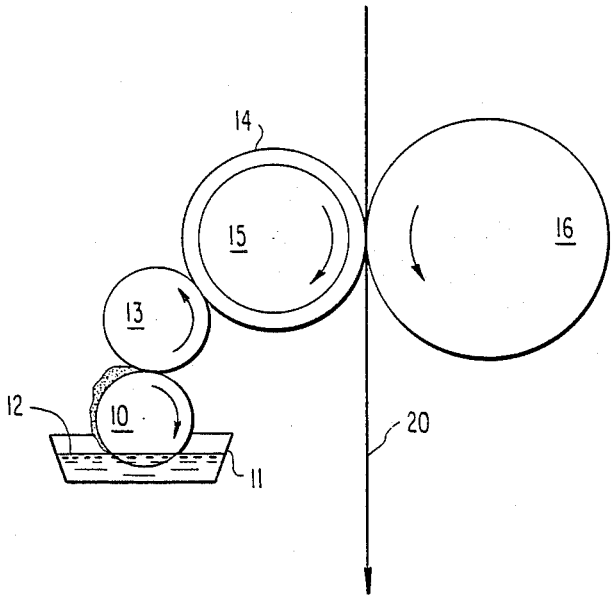
14
15
16
13
12
10
11
20

FLEXOGRAPHIC PRESS APPLIED PAPER COLOR COATING

This is a division of application Ser. No. 06/766,647, filed 8-19-85, now abandoned.

BACKGROUND OF THE INVENTION

1. Field Of The Invention

The present invention predominately relates to flexographic printing processes. More particularly, the invention relates to a process for uniformly applying a water-based color coating or ink to the entire surface area of a paper web side which represents the material supply for a converting apparatus such as an envelope machine.

2. Description Of The Prior Art

Large numbers of stationery users require or desire colored envelopes and/or letter sized paper. For standardized colors, sizes and shapes, colored stationery needs are met with colored paper in which the colorant is blended with the paper stock before a web therefrom is laid on a papermachine. By this process, economics require large orders and inventories of a given paper color.

Small orders of uniquely colored envelopes are particularly difficult to meet, economically. Traditionally, such envelopes have been manufactured from white, substantially uncoated paper by a process which includes a flexographic print coating of the envelope machine supply web with a coating of solvent based ink: except in those areas where the envelope gum or adhesive is to be applied. This exception was necessary to accommodate the fact that the usual non-toxic envelope gums will not adhere to solvent ink coated surfaces.

Notwithstanding the gum adherence difficulty with solvent ink, water-based inks have not been used in these applications due to the curling consequences of water-based ink upon the web. Envelope machines are extremely critical with requirements of a flat, uniform web surface. Excess water vehicle absorbed by the web from the prior art water-based inks made the supply web warp, wave and curl.

It is, therefore, an object of the present invention to teach a water-based ink formulation and process of applying it that will not curl or distort a substantially uncoated paper web.

Another objective of the present invention is to teach a method of color coating an envelope machine supply web without the necessity of color omitted print areas to accommodate traditional gum adhesives.

Another objective of the present invention is to teach a converting machine supply web coloring process having such economic advantage over solvent based coloring systems as to reduce the ink costs of such colored envelopes by 30%–40%.

BRIEF DESCRIPTION OF THE DRAWING

The single FIGURE of the drawing schematically illustrates those elements of a flexographic printing machine to which the invention specifically relates.

DESCRIPTION OF THE PREFERRED EMBODIMENT

Practice of the present invention requires coordination of flexographic printing machine parameters along with ink formulation parameters. The printing machine is schematically illustrated by the drawing to include a rubber or elastomer covered fountain roll 10 disposed to rotate within an ink reservoir 11. An immersed chordal section of the fountain roll picks up ink by surface adhesion from the ink pool 12 for metered delivery to the surface of an anilox roll 13. Characteristic of an anilox roll is a textured surface which regulates the quantity of ink carried by the texture cell volume.

Ink held by the texture cells of the anilox roll 13 is transferred to the image plate 14 carried by a plate cylinder 15. Conventionally, the plate surface is profiled with raised surface elements in the image pattern to be transferred to the web 20. Impression roll 16 provides a resilient backing surface for nip confinement of the web 20. In the present invention, however no image pattern is desired and the surface of image plate 14 is smooth.

Among these prior art elements of the present flexographic machinery are a combination of critical characteristics and mechanical parameters essential to successful practice of the invention.

Although the fountain roll 10 is traditionally covered by rubber or similar elastomer, the present invention requires a Shore "A" durometer cure of 85 to 90 and an unusually fine finish of approximately 64 microinches surface roughness height.

Combined with the aforesaid special fountain roll is a laser engraved ceramic coated anilox roll 13 having a 380–408 lines per inch tight packed interlaced pattern with cell depth values of 19–21$\mu$. While we have found this to give optimum results, we have also had satisfactory results with a mechanically engraved 400 P (pyramid) anilox roll with cell depths of 17–20$\mu$. Unique utility of the invention is in a continuous web 20 flow combination with a converting apparatus such as an envelope machine not shown. A mechanically engraved anilox roll 13 more coarse than the 400P and a laser engraved ceramic coated anilox roll more coarse than the 380–408 lines per inch will curl the web by transfer of an excessive volume of water. Such curling is intolerable to the converting machine which requires a smooth, flat web for uninterrupted operation. The allowable range of 17–20$\mu$ cell depth is used with discretion to regulate color strength and coverage.

In lieu of image profiled plates secured to the plate roll 15, a continuous elastomer covering 14 of approximately $\frac{1}{8}$ inch thickness is provided for the invention. Suitable elastomers may include natural rubber, ethylene propylene, nitrile, vinyl and polyurethane. Such elastomer cover is cured to 50–55 Shore "A" durometer hardness and given a surface finish of approximately 32 microinches surface roughness height. Cylindrical concentricity must be within 0.001 in.

The impression roll 16 of the invention combination is conventional for the prior art except for a 0.001 in. concentricity specification which is unusually accurate.

The ink element of the present coating system is basically a pigment color base combined in a water miscible resin binder carried by a water vehicle. The binder, Cartaretin F-4, is a proprietary cationic polyamide-amine resin product of the Sandoz Colors and Chemicals Co., 400 Monroe Road, Charlotte, N.C. 28205.

Formulations of the ink as represented by the following examples are prepared with a 15 to 16.5 second, No. 2 Zahn cup viscosity and 35–39 dynes/cm surface tension. Coverage uniformity is regulated by surface tension adjustment achieved by additions of ethyl alcohol in quantities of up to 10% of the mixture. These formulations are concentrates intended for approximately 1:1 water dilution prior to machine use. A particular machine will dictate the exact dilution ratio relative to desired color strength or intensity.

| EXAMPLE I - Ivory | |
|---|---|
| Water | 39.58% wt. |
| Monoethanolamine | 2.00 |
| Graphtol Yellow 4532-2 | 14.00 |
| Graphtol Orange 3333-2 | 4.00 |
| Cartaretin F-4 | 40.00 |
| Foamaster H | 0.02 |
| | 100.00% |

Monoethanolamine is a nitrogen compound of the alkanolamines family used to stabilize the mixture pH and preserve pigment dispersion. Graphtol Yellow 4534-2 and Graphtol Orange 3333-2 are proprietary pigment products of the Sandoz Colors and Chemicals Co., 4000 Monroe Road, Charlotte, N.C. 28205. Foamaster H is a proprietary defoaming agent of the Diamond Shamrock Chemicals Co., 350 Mt. Kemble Ave., Morristown, N.J. 07960.

| EXAMPLE II - Light Yellow | |
|---|---|
| Water | 25.98% wt. |
| Monoethanolamine | 2.00 |
| Graphtol Yellow 4534-2 | 32.00 |
| Cartaretin F-4 | 40.00 |
| Foamaster H | 0.02 |
| | 100.00% |

| EXAMPLE III - Blue | |
|---|---|
| Water | 59.48% wt. |
| Monoethanolamine | 2.00 |
| Artilene Blue 6812-5 | 8.50 |
| Cartaretin F-4 | 30.00 |
| Foamaster H | 0.02 |
| | 100.00% |

Artilene Blue 6812-5 is the proprietary pigment product of Sandoz Colors and Chemicals Co.

| EXAMPLE IV - Green | |
|---|---|
| Water | 31.08% wt. |
| Monoethanolamine | 2.00 |
| Graphtol Yellow 4534-2 | 16.40 |
| Graphtol Green 5869-2 | 4.00 |
| Artilene Blue 6812-5 | 6.50 |
| Cartaretin F-4 | 40.00 |
| Foamaster H | 0.02 |
| | 100.00% |

Graphtol Green 5869-2 is the proprietary pigment product of Sandoz Colors and Chemicals Co.

| EXAMPLE V - Gray | |
|---|---|
| Water | 74.10% wt. |
| Monoethanolamine | 1.00 |
| Carta Black BI Liquid 50% | 4.70 |
| Cartaretin F-4 | 20.00 |
| Foamaster H | 0.20 |
| | 100.00% |

Carta Black BI Liquid 50% is the proprietary pigment product of Sandoz Colors and Chemicals Co.

| EXAMPLE VI - Pink | |
|---|---|
| Water | 54.24% wt. |
| Monoethanolamine | 0.75 |
| Graphtol Red 1111-2 | 30.00 |
| Cartaretin F-4 | 8.00 |
| Foamaster H | 0.01 |
| Print Base GP | 7.00 |
| | 100.00% |

Graphtol Red 1111-2 is the proprietary pigment product of Sandoz Colors and Chemicals Co. Print Base GP is an organic solution of a rosin derived resin and the proprietary product of Sandoz Colors and Chemicals Co.

In addition to the previously described environmental advantages of the invention pertaining to elimination of toxic and hazardous vapor emissions, the invention also has the economic advantage of 30% to 40% savings in the finished envelope ink cost. At a 1400 fpm web speed, no converting machine production rate compromise is required to the present invention.

Having fully described our invention we claim:

1. A colored envelope production apparatus comprising a flexographic printing machine operatively combined with an envelope converting machine for uniformly coloring with a water-based ink a continuous web supply to said converting machine, said printing apparatus comprising an elastomer covered fountain roll having an elastomer cure of about 85 to 90 Shore "A" durometer and finished to a surface roughness height of about 64 microinches, an anilox roll adjacent said fountain roll having a ceramic coating engraved with 19 to 21$\mu$ deep cells distributed over an interlaced pattern of 380 to 408 lines per inch, and an elastomer covered plate roll adjacent said anilox roll of within 0.001 in. concentricity, cured to about 50 to 55 Shore "A" durometer and finished to a surface roughness height of about 32 microinches.

2. An apparatus as described by claim 1 wherein said printing apparatus further comprises an impression roll adjacent said plate roll and having a surface concentricity within 0.001 in.

3. A colored envelope production apparatus comprising a flexographic printing machine operatively combined with an envelope converting machine for uniformly coloring with a water-based ink a continuous web supply to said converting machine, said printing apparatus comprising an elastomer covered fountain roll having an elastomer cure of about 85 to 90 Shore "A" durometer and finished to a surface roughness height of about 64 microinches, an anilox roll adjacent said fountain roll having a surface texture of about 400 P and 17 to 20$\mu$ cell depth, and an elastomer covered plate roll adjacent said anilox roll of within 0.001 in. concentricity, cured to about 50 to 55 Shore "A" durometer and finished to a surface roughness height of about 32 microinches.

4. An apparatus as described by claim 3 wherein said printing apparatus further comprises an impression roll adjacent said plate roll and having a surface concentricity within 0.001 in.

* * * * *